United States Patent [19]

Ragen

[11] 4,242,003

[45] Dec. 30, 1980

[54] MULTI-PASS MATRIX PRINTING

[75] Inventor: Robert A. Ragen, Hayward, Calif.

[73] Assignee: Xerox Corporation, Stamford, Conn.

[21] Appl. No.: 952,040

[22] Filed: Oct. 16, 1978

[51] Int. Cl.[3] ..... B41J 3/12

[52] U.S. Cl. ..... 400/124; 101/93.05

[58] Field of Search ..... 400/124, 121, 320, 322, 400/323, 328, 126; 101/93.05

[56] References Cited

U.S. PATENT DOCUMENTS

| | | | |
|---|---|---|---|
| 2,997,361 | 8/1961 | Christopherson et al. | 346/74 |
| 3,484,791 | 12/1969 | Saeger et al. | 346/74 |
| 3,518,699 | 6/1970 | Mitchell | 346/74 |
| 3,684,075 | 8/1972 | Staller et al. | 400/120 |
| 3,690,431 | 9/1972 | Howard | 400/124 |
| 3,703,949 | 11/1972 | Howard et al. | 400/124 |
| 3,708,050 | 1/1973 | McCarthy | 400/124 |
| 3,715,020 | 2/1973 | Nordin | 400/124 |
| 3,789,969 | 2/1974 | Howard | 400/124 |
| 3,792,767 | 2/1974 | Marum | 400/124 |
| 3,802,544 | 4/1974 | Howard et al. | 400/124 |
| 3,810,189 | 5/1974 | Casperson et al. | 346/74 ES |
| 3,823,397 | 7/1974 | Howard et al. | 340/347 DD |
| 3,826,915 | 7/1974 | Giolitti et al. | 346/74 E |
| 3,833,891 | 9/1974 | Howard et al. | 400/124 X |
| 3,858,703 | 1/1975 | Duley | 400/124 |
| 3,900,094 | 8/1975 | Larsen et al. | 400/124 |
| 3,934,695 | 1/1976 | Kovalick | 400/124 |
| 3,938,641 | 2/1976 | Fulton | 400/124 |
| 3,950,685 | 4/1976 | Kramer | 400/280 X |
| 3,970,183 | 7/1976 | Robinson et al. | 400/124 |
| 3,973,662 | 8/1976 | Fulton | 400/124 |
| 3,990,559 | 11/1976 | Martin et al. | 400/124 |
| 3,991,868 | 11/1976 | Robinson et al. | 400/124 |
| 4,020,939 | 5/1977 | Quaif et al. | 400/124 |
| 4,029,190 | 6/1977 | Ragen et al. | 400/124 |
| 4,033,443 | 7/1977 | Bunge et al. | 400/124 |
| 4,037,705 | 7/1977 | Martin et al. | 400/124 |
| 4,059,183 | 11/1977 | Hoskins | 400/124 |
| 4,066,941 | 1/1978 | Foster | 318/685 X |
| 4,071,130 | 1/1978 | Lichti | 400/124 |
| 4,159,882 | 7/1979 | Sanders et al. | 101/93.05 X |

FOREIGN PATENT DOCUMENTS

| | | | |
|---|---|---|---|
| 1157237 | 7/1969 | United Kingdom | 400/119 |
| 1297237 | 11/1972 | United Kingdom | 400/124 |
| 1419265 | 12/1975 | United Kingdom | 400/124 |
| 1506038 | 4/1978 | United Kingdom | 400/124 |
| 1541641 | 3/1979 | United Kingdom | 400/110 |

OTHER PUBLICATIONS

IBM-TDB, vol. 20, No. 7 Dec. 1977, pp. 2528-2530.
IBM-TDB, vol. 20, No. 12, May 1978, pp. 5097-5098.

*Primary Examiner*—Paul T. Sewell
*Attorney, Agent, or Firm*—Barry Paul Smith

[57] ABSTRACT

In a printer including a record material movable past a printing station, and a print assembly capable of printing a line of characters in dot matrix format upon relative movement of the print assembly and the record material in a first direction, a method and apparatus is disclosed for printing the line of characters. In accordance with such method and apparatus, the print assembly and record material are first moved relative to one another in the first direction at a first predetermined speed. Then, the print assembly is activated to print a first predetermined number of dots of the dot matrix pattern defining each character in the line. This is followed by moving the print assembly relative to the record material a predetermined amount in a second direction perpendicular to the first direction, and effecting relative movement of the print assembly and the record material in a third direction opposite the first direction. Then, relative movement is effected between the print assembly and the record material in the first direction again, but at a second predetermined speed. This is followed by activating the print assembly to print a second predetermined number of dots of the dot matrix pattern defining each character in the line.

18 Claims, 7 Drawing Figures

MULTI-PASS MATRIX PRINTING

BACKGROUND OF THE INVENTION

This invention relates to matrix printing and, more particularly, to matrix printing using a printer of the type including a record material movable past a printing station, and a print assembly capable of printing a line of characters in dot matrix format upon relative movement of the print assembly and the record material.

There are a number of varieties of printers of the general type above described. First, there are serial matrix printers wherein the record material is moved in a first direction past the printing station, and the print assembly is capable of printing a line of characters sequentially (in series) in dot matrix format upon relative movement of the print assembly and the record material in a second direction perpendicular to the first direction. Typical serial matrix printers use a number of different types of print assemblies, such as wire-matrix print heads (e.g. ballistics heads of the type disclosed in U.S. Pat. Nos. 3,929,214 and 4,029,190) and ink jet heads.

A second variety of printers of the general type above described are line matrix printers, normally using an entire line's complement of print wires operated to print an entire line of characters simultaneously, as opposed to sequentially as in serial matrix printers. Ink jet printing assemblies could also be used in line printing.

An example of a serial matrix printer using a ballistics wire matrix print head is the Diablo Series 2300 matrix printer manufactured by Diablo Systems, Inc. of Hayward, California. A description of that printer appears in the Series 2300 Matrix Printer Maintenance Manual therefor which is contained in the file wrapper of the application, inasmuch as a preferred embodiment of the invention includes a number of components that are used in the Diablo 2300 printer.

Serial matrix printers, such as the Diablo Series 2300, may be operated at different carriage speeds in order to achieve different degrees of horizontal dot density. Typically such matrix printers use a 9-wire matrix head in order to form characters in a 7-dot column, 4-dot row matrix format when printing at speeds of about 200 characters per second (cps). If the hammer firing sequence for the print wires in the matrix head remains constant and the carriage printing speed is decreased to 100 cps, for example, the characters may be formed in a 7-dot column, 7-dot row, thereby significantly increasing the horizontal dot density and thus resolution of the printed information.

The capability of achieving higher dot densities when decreasing the carriage printing speed does not solve the problems of being able to print equally high resolution characters with angled portions, e.g. 45° angled portions, such as is true with the letter "X". More specifically, slowing the printing speed to 100 cps would not contribute to a higher dot density and thus resolution along the 45° angled lines. Only a greater horizontal dot density is possible, which would benefit such characters as the letter "E".

Very recently, a serial matrix printer has been introduced that has a high resolution printing capability for all characters. The printer is first operated at a constant speed (e.g. about 180 cps) from left to right, printing characters in a 7-dot column, 4-dot row matrix, as is conventional. However, then the record material is advanced a distance equal to a fraction, e.g. one-quarter, of the distance between adjacent dot centers in a vertical dot column, and the carriage is returned from right to left at the same speed, but this time printing some of the interspersed dots of the same characters. Two additional printing passes (left to right and then right to left) are accomplished with the record material being advanced additional quarter vertical dot spaces prior to each pass. The printing resolution is excellent in this four-pass system. However, in order to achieve a horizontal offset of the dots in each of the second through fourth passes consistent with the quarter vertical dot space advancement of the record material prior to each such pass, such being required in order to interspace dots along 45° diagonal lines, it is necessary to use a relatively complex variable hammer firing system. Variation of hammer firing cycles between the different passes is required due to the fact that all four passes are accomplished at the same constant speed.

It would be desirable, therefore, to be able to print high resolution characters in accordance with a multipass printing system wherein the hammer firing sequence need not be varied, thereby preserving the relative simplicity of the hammer firing timing control.

SUMMARY OF THE INVENTION

In accordance with one aspect of the invention, an apparatus is provided for printing a line of characters by use of a printer including a record material movable past a printing station, and a print assembly capable of printing a line of characters in dot matrix format upon relative movement of said print assembly and said record material in a first direction. The apparatus comprises means for effecting relative movement between said print assembly and said record material in said first direction at a first predetermined speed; means responsive to said relative movement in said first direction at said first predetermined speed for activating said print assembly during said relative movement to print a first predetermined number of dots of the dot matrix pattern defining each character in said line; means responsive to the printing of said first predetermined number of dots for effecting relative movement between said print assembly and said record material a predetermined amount in a second direction perpendicular to said first direction, and for effecting relative movement between said print assembly and said record material in a third direction opposite said first direction; means responsive to said relative movement in said second and third directions for effecting relative movement between said print assembly and said record material in said first direction at a second predetermined speed; and means responsive to said relative movement in said first direction at said second predetermined speed for activating said print head during said relative movement to print a second predetermined number of dots of the dot matrix pattern defining each character in said line.

In accordance with another aspect of the invention, a method is provided for printing a line of characters by use of a printer including a record material movable past a printing station, and a print assembly capable of printing a line of characters in dot matrix format upon relative movement of said print assembly and said record in a first direction. The method comprises the steps of effecting relative movement between said print assembly and said record material in said first direction at a first predetermined speed; activating said print assembly during said relative movement to print a first predetermined number of dots of the dot matrix pattern defining each character in said line; effecting relative movement between said print assembly and said record material a predetermined amount in a second direction perpendicular to said first direction, and in a third direction opposite said first direction; effecting relative movement between said print assembly and said record material in said first direction at a second predetermined speed; and activating said print head during said relative movement to print a second predetermined number of dots of the dot matrix pattern defining each character in said line.

In accordance with the preferred embodiment, the printer is a serial printer wherein the first and third directions are horizontal and the second direction vertical. Also in accordance with the preferred embodiment, the print assembly includes a wire matrix print head, such as the type disclosed in the aforementioned U.S. Pat. No. 3,929,214. Further in accordance with the preferred embodiment, each character capable of being printed on a line has two or more character dot matrix representations thereof stored in a font memory. The first representation is stored in binary format and represents the desired dot matrix pattern when printed at a first speed, e.g. 100 cps, whereas the second representation is stored in binary format and represents the desired dot matrix pattern when printed at a second speed, e.g. 200 cps. For example, the first dot column for the letter "E" at 100 cps might be represented by the 7-bit binary code "1111111," the second through fifth dot columns at 100 cps by the 7-bit binary code "1001001", and the sixth and seventh dot columns by the 7-bit binary code "1000001". The record material may then be advanced by an amount equal to one-half the distance between adjacent vertical dot centers (i.e. a vertical dot space), and then the second representation for the "E" printed. In the case of the second dot matrix representation for an "E", all seven dot columns would be binary "0000000", since the "E" would hae been fully formed at the desired high resolution after the first pass at 100 cps, i.e. the first dot matrix representation contains the desired horizontal and vertical dot density.

In the above example, the first and seventh dot columns for the letter "X" at 100 cps would be represented by the 7-bit binary code "1000001", the second and sixth by the binary code "0100010," the third and fifth dot columns by the binary code "0010100" and the fourth dot column by the binary code "0001000". During the second pass at 200 cps, the seven dot columns will be offset vertically by one-half vertical dot space due to the intervening movement of the record material. In accordance with the invention, these seven dot column will also all be offset horizontally by one-half dot space by maintaining the hammer firing frequency or sequence the same at both 100 cps and 200 cps. For the letter "X" printed in a 200 cps dot matrix representation, the first and sixth dot columns would be represented by binary code "1000010", the second and fifth dot columns by the code "0100100", the third and fourth columns by the code "001100", and the seventh dot column by the code "0000000". This example is depicted in FIGS. 5–7 and will be described in more detail below.

Also in accordance with the preferred embodiment, the horizontal space on a line designated for printing each character is preferably 10 dot columns in length, wherein the first two and last dot columns are used as spacers between adjacent characters and the middle seven dot columns are used to form the character. A "count-10" counter is used to keep track of the position of the head with respect to the 10 dot columns of each character space at all times. The value of this counter is used in conjunction with the binary code identifying each character to define an address for the font memory in which the dot column binary data is stored. Thus, each font memory address comprises at least a 7-bit ASCH character code, four count-10 bits, and one dot matrix representation bit for identifying either the 100 cps or the 200 cps dot matrix representation of each character.

A typical 16-bit address for an 8-bit word ROM comprising storage locations for velocity tables and programs as well as dot matrix representations, would have the seven least significant bits defined by the 7-bit ASCH character code, the 8th bit left unused and always at binary "0". The 9th–12th bits would be defined by the output of the count-10 dot column counter, the 13th bit would be used to define selectively the storage locations for other dot matrix representations, such as, for example, the 100 cps and 200 cps dot matrix representation of each character capable of being printed. The 14th–16th bits could be used to define the basic main storage areas in the ROM. As indicated, therefore, the least significant 12-bits of the address define a separate dot column of the dot matrix pattern for each character.

These and other aspects and advantages of the present invention will be described in more detail below with reference to the accompanying drawings.

DESCRIPTION OF THE PREFERRED EMBODIMENT

Figure 1:
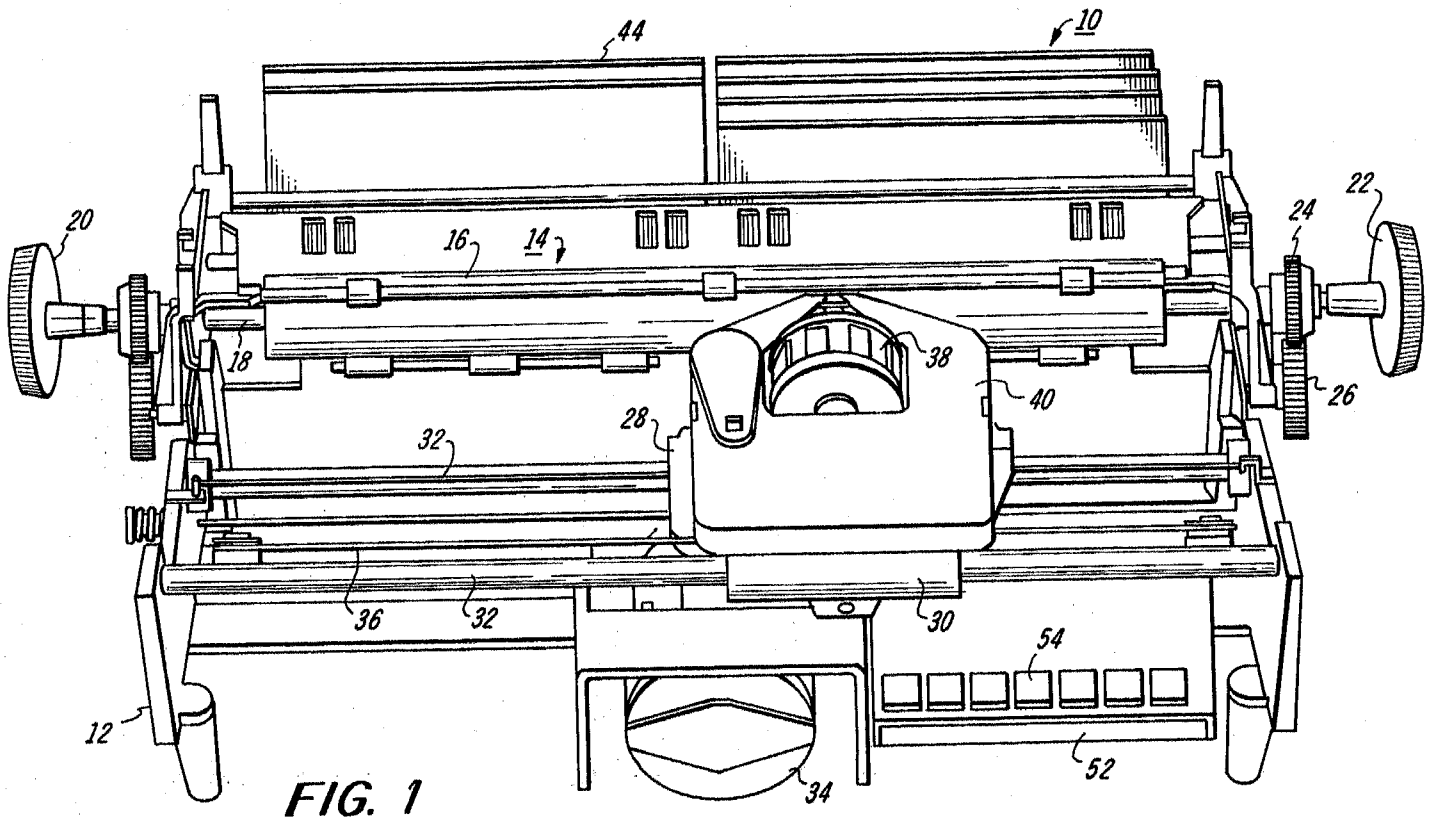
FIG. 1 is a front perspective view of a serial matrix printer incorporating the principles of the invention therein.

Referring to FIG. 1, a printer 10 incorporating the principles of the present invention is shown. The printer 10 is preferably a serial matrix printer and includes a unitary frame 12 to which a platen assembly 14 is mounted for rotation about its axis. More specifically, the platen assembly 14 includes a platen 16 mounted to a shaft 18 for rotation therewith. The shaft 18 is, in turn, rotatably mounted to the frame 12 and includes a pair of knobs 20 and 22 mounted at respective ends of the shaft for enabling manual controlled rotation of the shaft 18 and platen 16. As is conventional, the knob 20 is fixed to the shaft and the knob 22 is movable axially of the shaft between first and second positions. When in a first position, a gear-drive assembly 24 mounted about the shaft 18 adjacent the knob 22 is engaged with the shaft so that a motor-gear arrangement 26 (only partly shown) coupled to the gear-drive assembly 24 controls the automatic rotation of the shaft 18. When in a second position, the knob 22 disengages the gear-drive assembly 24 from the shaft so that manual rotation of the knobs 20 and 22 wil cause a corresponding rotation of the shaft 18 and platen 16.

The printer 10 also includes a carriage assembly 28 mounted by a pair of bearing members 30 (only one shown) to a respective pair of rails 32 which are themselves mounted at each end to the frame 12 of the printer 10. A drive motor 34 is coupled by a suitable cable-pulley arrangement 36 to the carriage assembly 28. The carriage assembly 28 generally includes and is adapted to transport a print assembly 38 which is desirably comprised by a wire matrix print head. Print head 38 may be of any suitable type, but preferably is of the type disclosed in the aforementioned U.S. Pat. No. 3,929,214. The print head 38 is fixed to the carriage assembly along with a ribbon cartridge 40 for advancing inked ribbon between the matrix print head 38 and the platen 16, and a portion of a ribbon cartridge drive assembly (not shown) for transporting the ribbon in front of the matrix print head 38 during operation of the printer 10. Any suitable ribbon cartridge may be employed in accordance with the invention, although a presently preferred one is disclosed in U.S. Pat. No. 4,091,913.

As is conventional, the print head 38 comprises a plurality of wires (not shown) arranged in a vertical array at the end of the head adjacent the platen 16. Each character to be printed is formed by a predetermined number of closely adjacent dot columns. The dots of each column are formed by selective activation of appropriate wires in the head 38 to propel them and the adjacent inked ribbon against a record material supported about the platen 16. Activation of the wires at the appropriate times and in respone to input character commands may be accomplished by suitable hardware and microcode included in a control system 42 (FIG. 2) whose electronic hardware components are mounted on circuit boards 44. As is the case with most serial matrix printers, characters are printed "on-the-fly", i.e. as the carriage assembly 28 is being moved continuously in one direction or the other. The specific manner in which the characters are printed forms an important part of the present invention and will be described in more detail below.

Further details of the specific mechanical components of the printer 10 depicted in FIG. 1 may be had through a review of the aforementioned U.S. Pat. No. 4,091,913, as well as the above noted Series 230 Manual.

Figure 2:
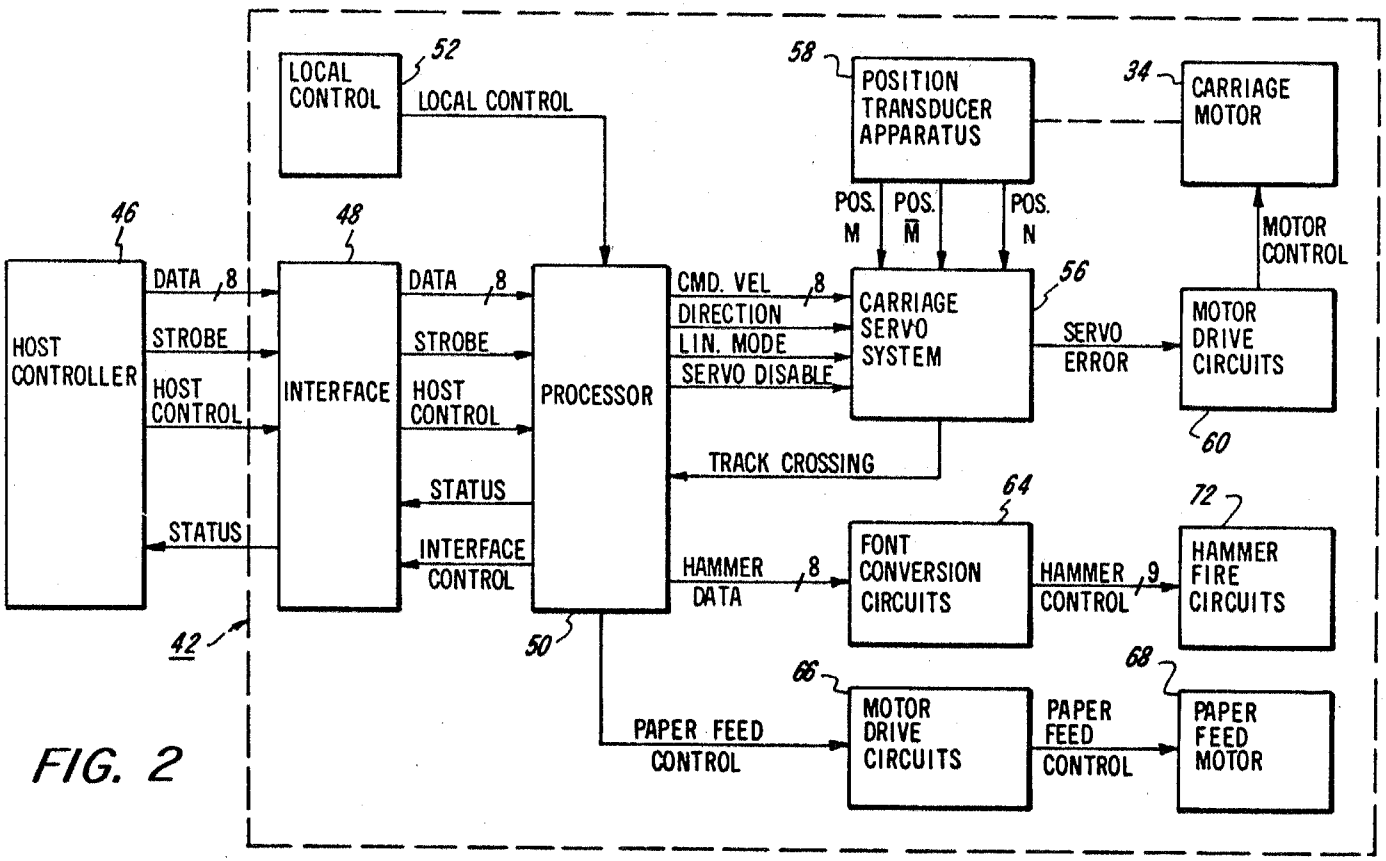
FIG. 2 is a schematic block diagram of the control system of the printer of FIG. 1.

Prior to describing the control system 42 of FIG. 2, it should be noted that such control system is adapted to receive and transmit various signals from and to a suitable host controller 46. Signals coming to the printer 10 from the host controller 46 normally include an 8-bit DATA signal that includes, as its 7 least significant bits, a 7-bit ASCH code command representing either one of a number of alphanumeric characters to be printed or one of a number of control functions to be carried out. The most significant 8th bit is not used and is always binary zero. A table setting forth the preferred input ASCH codes appears in detail in Table 1—1 on page 1-3 of the Series 2300 Manual.

The host controller 46 also sends out STROBE signals in the form of pulses wherein each strobe pulse signifies that another 8-bit DATA signal is being supplied. The host controller 46 also supplies various special host control signals, e.g. RESTORE, to the printer 10. As is conventional, a RESTORE command will cause the carriage 28 to return to its "home" position. The host controller 46 lastly receives various status signals generated by the printer 10, such as "ACKNOWLEDGE" (which signifies the printer acknowledges the receipt of an 8-bit DATA signal, and "BUSY" (which indicates that the printer cannot receive new data at that moment).

As shown in FIG. 2, the control system 42 includes a suitable interface circuit 48 having input terminals adapted to receive the 8-bit DATA signals, STROBE signals and host control signals from the host controller 46. Additionally, the interface 48 has output terminals for supplying status signals to the host controller 46. The interface 48 has further output terminals for supplying 8-bit DATA signals, STROBE signals and host control signals to a processor 50 included in the control system 42. Lastly, the interface 48 includes input terminals for receiving status signals and interface control signals from the processor 50. Any suitable interface circuit 48 capable of handling the aforementioned input and output signals may be employed. However, a presently preferred interface circuit is disclosed in Series 2300 Manual.

The control system 42 of the printer 10 also includes a local control station 52 (FIGS. 1 and 2) for generating various local control signals and applying them directly to the processor 50. More specifically, the local control station 52 includes a plurality of selector switches (not shown) actuated by various push-buttons 54. These buttons preferably initiate such functions as power turn-on, double-line spacing, line feed, et al. The nature of presently preferred local control functions are disclosed in the above noted Series 2300 Manual. Additional local control functions initiated by additional associated push-buttons 54 could be used to cause either (1) normal resolution printing by only one pass at 200 cps, (2) higher resolution printing by only one pass at 100 cps or (3) still higher resolution printing by two or more passes, e.g. one at 100 cps and another at 200 cps in accordance with the present invention. These three different printing methods, especially the third which relates to the present invention, will be described in more detail below. At this point, however, it should be noted that these resolution selection functions can also be controlled by appropriate host control signals from the host controller 46.

The processor 50 includes hardware and associated mircrocode to be described below for processing the incoming 8-bit DATA, STROBE and host control signals from the interface circuit 48, as well as local control signals from the local control station 52 and "TRACK CROSSING" signals from a carriage servo system 56. As will be seen below, the TRACK CROSSING signals are used to define the hammer firing cycle for the matrix print head 38 and are comprised of pulses that occur at a frequency proportional to the speed of carriage 28. In response to such processing, the processor 50 generates an 8-bit COMMAND VELOCITY signal that is received by the carriage servo system 56 to control the speed of movement of the carriage 28, a DIRECTION signal that is used by the carriage servo system to control the direction of movement of the carriage 28, a LINEAR MODE signal for controlling the switching of the servo system 56 from a velocity positioning mode to a linear positioning mode, and a SERVO DISABLE signal for disabling the servo system 56 when no motion of the carriage 28 is taken place or pending.

The carriage servo system 56 is preferably of the well-known "dual-mode" type, such as is disclosed in U.S. Pat. No. 4,091,911. Thus, the servo system 56 receives three mutually phase-displaced position signals M, $\overline{M}$ and N, each representative of the positional movement of the carriage 28. The signals M, $\overline{M}$ and N are desirably triangular in shape and are generated by a position transducer apparatus 58 that is preferably of the type disclosed in U.S. Pat. No. 4,047,086. The servo system 56 includes conventional circuitry for deriving from the position signals M, $\overline{M}$ and N an ACTUAL VELOCITY signal representative of the actual velocity of the carriage 28, and the TRACK CROSSING signal that is preferably a pulse signal having pulses occurring at each zero-crossing one of the triangular-wave position signals M, $\overline{M}$ and N. The TRACK CROSSING SIGNAL is applied to the processor 50 to define the firing cycle for the matrix print head 38 in a manner to be described below. The position transducer apparatus 58 includes a position transducer (not shown) connected to the shaft of the carriage motor 34. In this manner, the frequency of the position signals M, $\overline{M}$ and N, as well as the TRACK CROSSING signal are proportional to the motor speed and thus the speed of the carriage 28.

The servo system 56 compares the ACTUAL VELOCITY signal it derived from the position signals M, $\overline{M}$ and N with the COMMAND VELOCITY signal from the processor 50 during a velocity carriage positioning mode. When the carriage is within a predetermined distance from its desired stopping position, e.g. one dot column, the processor 50 generates a LINEAR MODE signal to essentially substitute one of the position signals M, $\overline{M}$ and N for the COMMAND VELOCITY signal in comparing with the ACTUAL VELOCITY signal, as in conventional. The SERVO ERROR signal derived from such comparisons is supplied to motor drive circuits 60 where it is amplified before being supplied to the carriage motor 34 as a MOTOR CONTROL signal. The amplitude of this signal controls the acceleration, deceleration and utimate speed of the motor 34 (FIG. 1), and the sign controls the direction of motor rotation.

Figure 3:
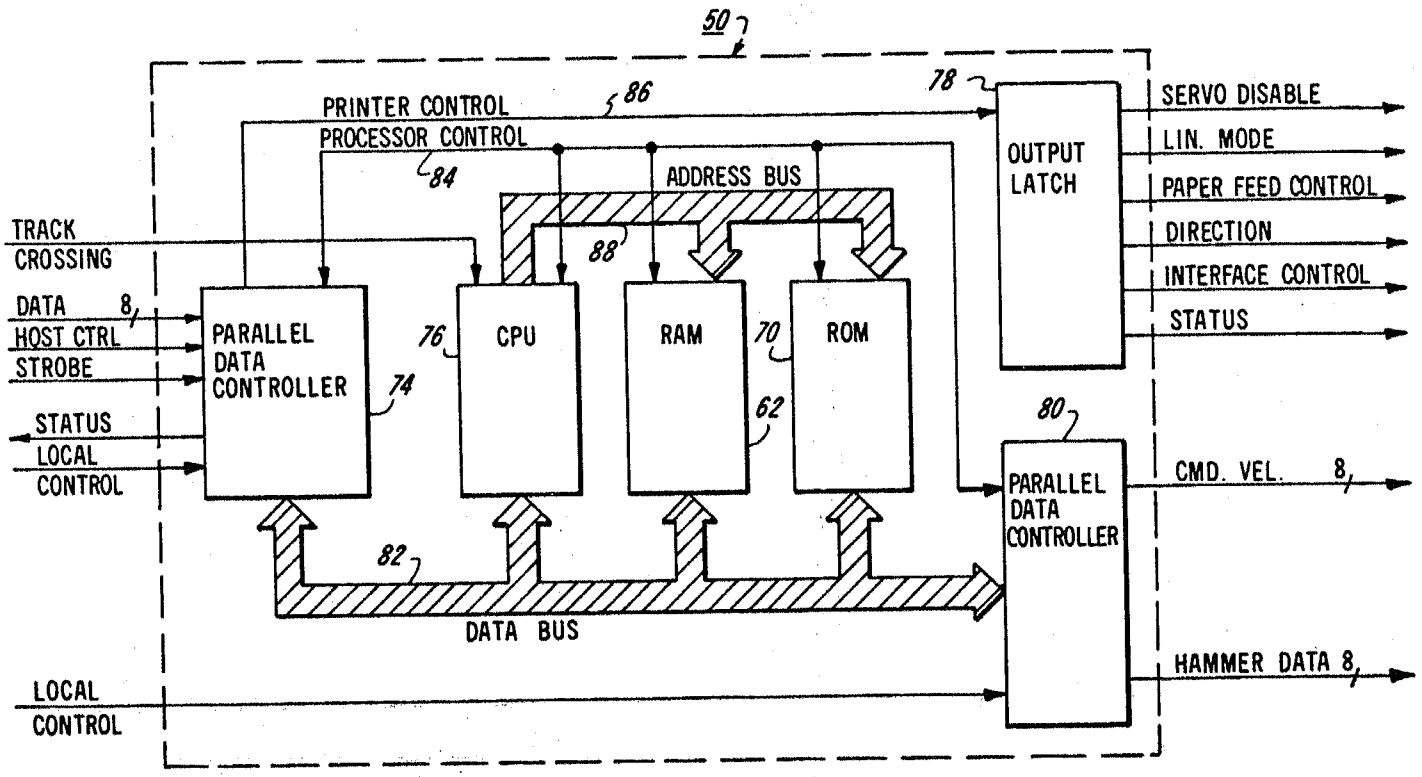
FIG. 3 is a schematic block diagram of the processor depicted in FIG. 2.

Still refering to FIG. 2, the processor 50 responds to the incoming 8-bit DATA signals, some of which are representative of charcters to be printed, and others of which are representative of various functions, such as horizontal and vertical tab control, et al. All of the 8-bit DATA signals for a complete line are received in series by the processor 50 and stored in a line buffer register defined in various storage locations in a randam-access-memory (RAM) 62 (FIG. 3). The characters may be printed at the appropriate locations along the line by the processor 50 supplying 8-bit HAMMER DATA signals to font conversion circuits 64. Each 8-bit HAMMER DATA signal represents a unique dot column pattern for a particular one of the charcters making up the line. As will be seen below, each character space on the line comprises ten dot columns of which the two leading dot columns and one trailing dot column are together used as an intercharacter space. In this intercharacter space, no wires of the matrix head 38 would be energized, i.e. the three 8-bit HAMMER DATA signals are each "00000000" for the three dot columns defining the intercharacter space. The remaining seven dot columns define a character to be printed in the ten dot column character space.

The font conversion circuits 64 respond to the 8-bit HAMMER DATA signals from the processor 50 to derive a 9-bit HAMMER CONTROL signal for the wire matrix print head 36, wherein each of the nine bits controls the activation of one of the nine hammers. More specifically, the seven most significant bits of the 8-bit HAMMER DATA signals contain the data for a dot column of a character, whereas the 8th least significant bit is a conversion bit. When bit-8 is binary 0, for example, bits 1–7 will be respectively applied to hammer coils 1–7; whereas when bit-8 is binary 1, bits 3–7 will be applied to hammer coils 3–7 and bits 1 and 2 to hammer coils 8 and 9. In this manner, characters such as g and j, which require dots in two positions below the normal base line, can have such two dot positions (8 and 9) stored in bit locations 1 and 2 of the 8-bit hammer data word, and yet used to fire hammers 8 and 9. Thus, a conventional 8-bit read-only-memory (ROM) 70 (FIG. 3) may be used to store HAMMER DATA signals to activate either the first seven or last seven of nine hammers of the head 36.

Further details of the font conversion circuits 64 will be described below in connection with FIG. 4 and may also be obtained through a review of U.S. Pat. No. 4,029,190. At this point, however, it should be noted that the 9-bit HAMMER CONTROL signal from the font conversion circuits 64 is applied in parallel to nine hammer fire circuits 72 for controlling the firing of the nine hammers of the print head 36.

In the case of horizontal tabbing, no HAMMER DATA signal for the tabbing space between characters would be supplied. The carriage would just be moved to the desired tab stop at the optimum velocity, as will be described below. Horizontal tabbing is controlled by one of the 8-bit DATA signals (i.e. least significant 7-bit ASCHII code - Octal 011)from the host controller 46 that causes the carriage 28 to advance to the next tab stop. Tab stops can be set by positioning the carriage 28 to the desired tab stop location on the print line, and then issuing an ESC code (Octal 033) from the host controlled 46 followed by the Digit 1 code (Octal 061). See the series 2300 manual. Tab stops can also be set directly without positioning the carriage by issuing the command code ESC and then the CR code (Octal 015), followed by an ASCII character code whose tab stop location is the binary value of the ASCII character.

The processor 50 also generates paper feed control signals that are amplified by motor drive circuits 66 and then applied to the paper feed motor 68, which is desirably a stepper motor, for controlling the amount and direction of paper advance. As will be seen below, in the multi-pass (particularly dual-pass) method of invention, the paper is advanced upwardly one-half the distance between the centers of adjacent vertical dots, i.e. one-half of a dot space after the second pass. Paper advance may also be initiated by vertical tabbing. Tabbing is controlled by one of the 7-bit ASCII codes in an 8-bit DATA signal from the host controller 46 through the interface 48. The desired code is Octal 013. Vertical tabs are set by establishing a top-of-form reference, then positioning the paper to the desired vertical tab location using a series of LINE FEED (LF) local control commands, and then issuing an ESCAPE (ESC) code (Octal 033) from the host controller 46 followed by a Digit 8 code (Octal 070). Vertical tab stops can also be set directly without positioning the paper by issuing the command code ESC and then the SO code (Octal 016), followed by an ASCII character code whose tap stop location is the binary value of the ASCII character.

All tab stops, vertical and horizontal, may be cleared simultaneously by issuing from the host controller 46 the ESC code (octal 033) followed by the Digit 2 code (Octal 062). It must be emphasized that although we are talking about 7-bit ASCII codes, i.e. the Octal codes above referred to, these are merely the seven least significant bits of corresponding 8-bit DATA signals from the host controller 46, wherein the 8th bit is always binary 0.

Reference is now had to FIG. 3, wherein the processor 50 will be described in more detail. As shown, the processor 50 includes a parallel data controller 74 which is a flexible parallel input/output device for interfacing the processor 50 to external circuits. It provides two independent, bidirectional 8-bit input/output channels, each of which may operate in a variety of parallel data transfer modes. A CPU 76 also included in the processor 50 is able to designate these 16 lines to operate as either inputs or outputs in blocks of four lines.

The controller 74 has eight DATA signal inputs and a STROBE signal input, all working as one channel. The 8-bit DATA signals from the interface 48 are presented to the corresponding eight DATA signals inputs and the STROBE signal from the interface 48 is presented to the STROBE signal input. A transition of the STROBE signal causes the 8-bit DATA signal at the DATA signal input to be loaded into a buffer (not shown) in the controller 74. The controller 74 will then produce a status signal at an output that is applied directly to the interface 48 to delay the output of an ACKNOWLEDGE status signal from the processor 50 to the host controller 46 until the CPU 76 has accepted the 8-bit DATA signal from the internal buffer of the controller 74, as applied along an 8-bit data bus 82.

A second I/O channel of the controller 74 includes four inputs adapted to receive various control signals from the host controller 46 through the interface 48, as well as from the local control station 52. The nature of these control signals was alluded to above and are described in more detail in the series 2300 manual. The second I/O channel of the controller 74 also includes four outputs that apply various printer control signals to an output latch 78. Three of the four outputs act as an address for one of eight latches in the output latch 78, whereas the fourth output supplies the data to set the addressed latch. The output signals from the output latch 78 will be described below.

The RAM 62 of the processor 50 is a device preferably consisting of 2048 bits of read-write memory in a 256×8-bit configuration. It is used in the processor as a general working register, to define the vertical and horizontal tab tables, and as the processor's data buffer. The ROM 70 is preferably comprised of a single chip consisting of 65,536 bits of read-only-memory in a 8192×8-bit configuration. Alternatively, of course, two 4096×8-bit ROM's could be used. The ROM 70 is used in the processor 50 for the storage of all processor program instructions (microde), as well as various constants, such as a velocity table used to generate 8-bit COMMAND VELOCITY signals for application to the carriage servo system 56, and a font table used to generate 8-bit HAMMER DATA signals for application to the font conversion circuits 64.

The CPU 76 is an 8-bit parallel processor that contains all of the logic necessary to receive 8-bit program instruction words along the data bus 82 from the ROM 70, to decode such instruction words and to perform all the required arithmetic and logic operations. A presently preferred CPU is the Model No. PPS-8 Microcomputer manufactured by Rockwell International Corporation of Anaheim, California. Through a 16-bit address bus 88 connected from respective outputs of the CPU 76 to respective inputs of the RAM 62 and ROM 70, the CPU 76 is capable of addressing 8192 bytes (8 bits/byte) of read-only memory and 256 bytes of random-access-memory.

The processor 50 also includes another parallel data controller 80 that operates in a static output mode. In primarily functions as two groups of eight latched outputs from the data bus 82. One group of 8-bit outputs represents the 8-bit COMMAND VELOCITY signals supplied from the velocity table in ROM 70 along the data bus 82 to the controller 80. The other group of 8-bit outputs represents the 8-bit HAMMER DATA words supplied from the font table in ROM 70 along the data bus to the controller 80. The controller 80 receives three processor control commands along respective lines 84 from the controller 74. These lines carry TEST, LINE FEED and TOP FORM local control signals applied to the controller 74 from the local control station 52. These command signals are then applied in parallel along three of eight lines of the data bus 82 to the CPU 76 for effecting these operations.

It should be noted that, in accordance with the preferred embodiment, the velocity table in ROM 70 is addressed to supply 8-bit VELOCITY COMMAND data. More specifically, the velocity table contains a deceleration profile for decelerating to a stop condition anywhere along the print line or to a desired constant printing speed. From maximum velocity to a stop position, it takes about twelve character spaces (120 dot columns), whereas from a printing speed of 100 cps, it takes about one character space (10 dot columns) to stop, and from a speed of 200 cps, it takes two character spaces (20 dot columns) to stop. During tabbing, speeds can reach in excess of 500 cps, which accounts for the earlier commencement of deceleration. At times other than during deceleration, i.e. during acceleration up to the 100 cps or 200 cps printing speeds or in excess of about 500 cps tabbing speed, VELOCITY COMMAND signals representing such constant speed values are accessed from predetermined address locations in ROM 70 where they are stored as constants in the velocity table.

The output latch 78, as indicated above, has eight latches. A first latch, when addressed and set by appropriate printer control signals along line 86, raises the SERVO DISABLE signal for disabling the servo during periods of no actual or pending carriage motion. The CPU 76 commands a servo disable function along the data bus 82 to the controller 74, which then activates the appropriate printer control lines 86. Similarly, the 7 other latches of the output latch 78 may be set to respectively generate the LINEAR MODE, PAPER FEED CONTROL (there are two such phases-displaced signals), DIRECTION, INTERFACE CONTROL, ESCAPE RESET, BUSY RESET and BELL status signals. The PAPER FEED control signals are capable of incrementing the paper in either direction by as small an increment as at least one-half dot space (the distance between vertically adjacent dot centers), in accordance with the preferred dual-pass feature of the invention. Obviously, if more than two passes were to be effected, the paper advance would be by correspondingly smaller increments.

The manner in which the 8-bit HAMMER DATA signals from the ROM 70 are addressed for application to the font conversion circuits 72 wil now be described with continued reference to FIG. 3. In accordance with the invention, a portion of ROM 70 is designated to the storage of the dot column patterns for each character of each font type capable of being printed. Thus, an entire set of alphanumeric dot column patterns for English "elite" characters may be stored at one set of storage locations of the font table, another complete set for English "pica" at another set of storage locations, and so on. Obviously, different language formats may also define an alphanumeric set, e.g. Hebrew, Scandia, Norsk, German, French and APL (a computer programming language).

In accordance with the invention, which contemplates at least two separate printing passes, preferably one at 100 cps and another at 200 cps, a complete set of alphanumeric dot column patterns for printing a font style, e.g. English "elite," at 100 cps would be defined at one set of storage locations in the font table. Another separate complete set of alphanumeric dot column patterns for printing the same font style at 200 cps would be defined at another different set of storage locations. Thus, the character dot column patterns for each font style are treated as separate alphanumeric sets for the different printing speeds. The reasons for the relationship will become clear below when the preferred embodiment is described with reference to FIGS. 5–7. At this point, however, it should be noted that each alphanumeric set of dot column patterns stored in the ROM's font table are addressed by a 16-bit address signal along the address bus 88.

The seven least significant bits of the address are comprised of the 7-bit ASCII code from the interface 48, the eighth least significant bit is always binary 0 and all such 8-bits comprise an 8-bit DATA signal received from the interface 48. The seven least significant bits are capable of defining a unique alpha-numeric character (see ASCII table in the series 2300 manual). Since each ROM storage location in the font table stores an 8-bit HAMMER DATA signal defining the pattern of a particular dot column for a particular character, the next most significant four bits, i.e. bits 9–12 , of the address signal define the column position. These bits essentially comprise the output of a "count-10" counter defined in a RAM memory location. A count of ten is used to count the ten dot columns defining each character space. Accordingly, the 12 least significant bits of the 16-bit address define all dot column data for all characters of a set.

The 13th bit of the address may be used to jump between one set of locations for storing the dot column data for an alphanumeric set to be printed at 100 cps, and another set of locations for storing the dot columns data for the same style alphanumeric set to be printed at 200 cps offset one-half dot space vertically from the 100 cps set. The 14th bit of the address may be used to jump among different alphanumeric font styles (both 100 cps and 200 cps sets thereof) in the font table, and the 15th and 16th bits may be used to address other portions of the ROM, such as additional fonts, including velocity tables, and microcode program instructions.

Figure 4:
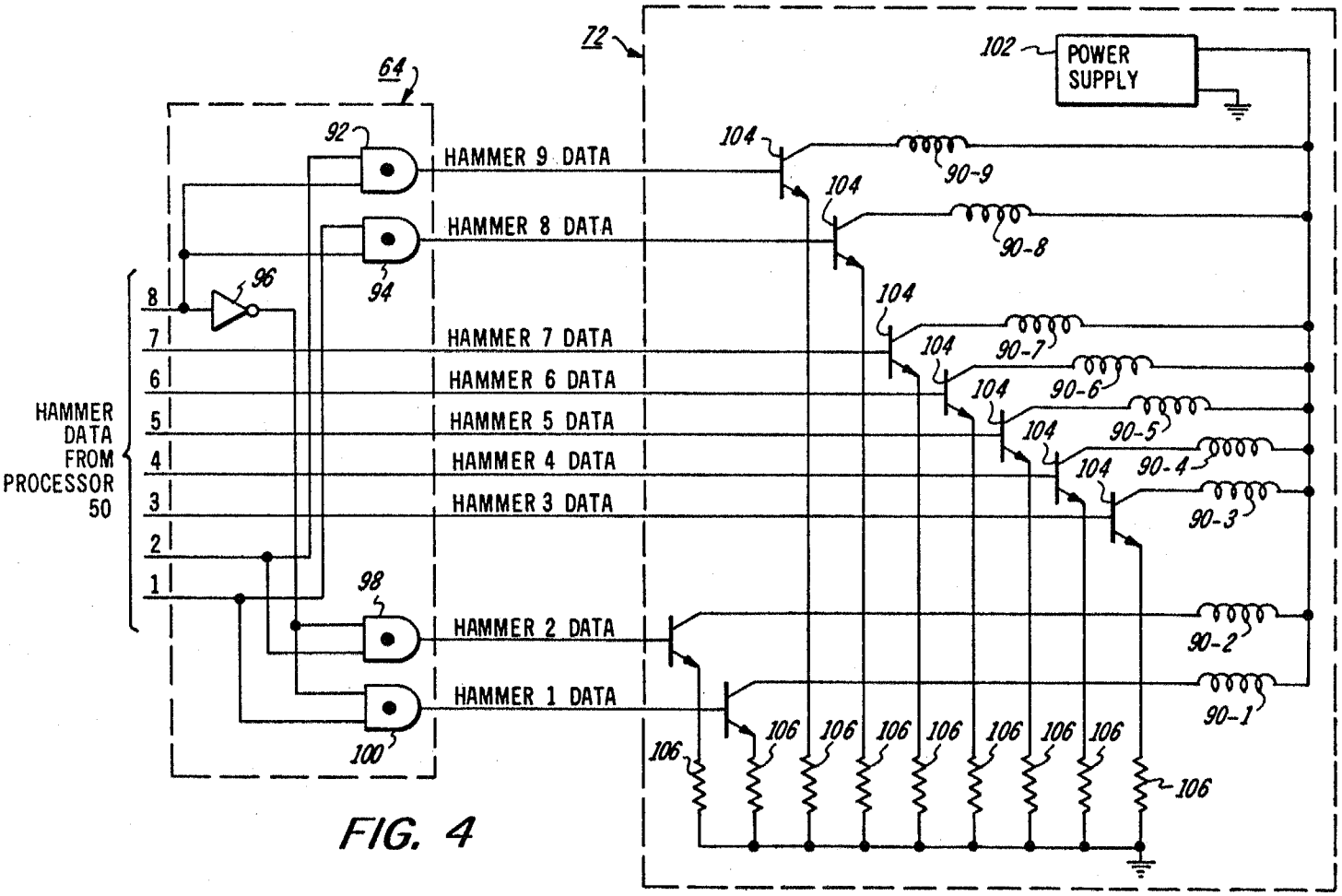
FIG. 4 is a schematic circuit diagram of the font conversion and hammer fire circuits depicted in FIG. 2.

Referring now to FIG. 4, when a 16-bit address signals for addressing one location in the font table is applied to the ROM 70 on the address bus 88, an 8-bit HAMMER DATA signal will appear at its output and will then be applied along the data bus 82 to the controller 80 and thence to the font conversion circuits 64. HAMMER DATA bits 3–7 are used to selectively actuate hammers 3–7 by energizing the print head hammer coils 90 associated with such hammers (not shown). These coils are hereinafter referred to as 90-1, 90-2, etc. and form part of the hammer fire circuits 72. The above relationship is true regardless of whether a letter to be printed is upper or lower-case. HAMMER DATA bits 1 and 2 either supply data for selectively energizing the coils 90 associated with hammer Nos. 1 and 2, i.e. coils 90-1 and 90-2, when upper-case letters and those lower-case letters not requiring a below normal line extension are to be imprinted, or supply data bits for selectively energizing the coils 90 associated with hammer Nos. 8 and 9, i.e. coils 90-8 and 90-9, when a lower-case character requiring a below normal line extension is to be imprinted.

To this end, HAMMER DATA bit 8 is designated as a conversion bit to indicate whether the HAMMER DATA bits supplied on output lines 1 and 2 is for coils 90-1 and 90-2, or for coils 90-8 and 90-9. As shown, the HAMMER DATA bit 8 from the processor 50 is coupled to a first input of each of two AND-gates 92 and 94, and is also coupled through an inverter 96 to a first input of each of two other AND-gates 98 and 100. The HAMMER DATA bits 1 and 2 from the processor 50 are respectively coupled to second inputs of the AND-gates 92 and 94, and to respective second inputs of the AND-gates 98 and 100. In this manner, when the eight bit is true, i.e. binary 1, only the AND-gates 92 and 94 and not AND-gates 98 and 100 will be enabled to pass the HAMMER DATA bits 1 and 2 respectively supplied thereto. On the other hand, when the eighth bit is false, i.e. binary 0, only the AND-gates 98 and 100 and not AND-gates 44 ad 46 will be enabled to pass the HAMMER DATA bits 1 and 2 respectively supplied thereto.

As shown in FIG. 4, each coil 90 is coupled between a power supply 102 and the collector electrode of a respective transistor switch 104. Each transistor switch 104 is, in turn, connected at its emitter electrode to ground through a resistor 106. Those transistor switches 104 having their collector electrodes respectively coupled to coils 90-3 through 90-7 have their base electrodes respectively connected to the HAMMER DATA lines 3-7. Additionally, those transistor switches 104 having their collector electrodes respectively coupled to the coils 90-8 and 90-9 have their base electrodes respectively connected to the outputs of the AND-gates 92 and 94, whereas those transistor switches 104 having their collector electrodes respectively coupled to the coils 90-1 and 90-2 have their base electrodes respectively connected to the outputs of the AND-gates 98 and 100.

Thus, for all upper-case letters and those lower-case letters not requiring an extension below the normal base line, enerigization of the coils 90-1 through 90-7 will bear a direct and respective relationship to the status of the HAMMER DATA bits on output lines 1–7 from the processor 50. For the lower-case letters requiring a lower extension, as exemplified by the letter"j", the two lowest dot positions, i.e. 8 and 9, of each column are supplied from the processor 50 on output lines 1 and 2 and then directed through the AND-gates 92 and 94 by providing a binary 1 bit on the output line 8.

Each of the nine electromagnetic actuating assemblies in the print head 36 is energized to cause its associated wire (not shown) to be propelled against an adjacent record medium in the manner above-described by energizing the coil 90 forming part of such actuating assembly for a predetermined period of time. This is done by allowing a predetermined level of current to flow through the coil 90 for such predetermined period of time. The latter is accomplished wih respect to any particular coil 90 when the data supplied to the base electrode of the associated switch 104 is true, i.e. binary 1, for the requisite period of time. A true data bit at the base electrode will turn the transistor switch 104 on, allowing current to flow to ground from the power supply 102, through the coil 90, transistor 104 and resistor 106. As soon as the data bit goes false, the transistor will turn off, inhibiting current flow, thereby de-energizing the coil 90 and causing the associated armature to be retracted.

The circuit depicted in FIG. 4 preferably also incorporates a protection circuit of the type disclosed in U.S. Pat. No. 4,071,874. This protection circuit has been deleted for purposes of simplicity in emphasizing the unique aspects of the present invention.

The operation of the printer 10 in carrying out the unique multi-pass printing method of the invention will now be described with reference to FIGS. 1–7. The 8-bit DATA signals containing a 7-bit ASCII code are received sequentially from the host controller 46 by the interface 48 and then passed onto the processor 50 which stores them in a line buffer defined at various locations in the RAM 62. When a predetermined portion of an entire line of ASCII coded data is stored in the line buffer, e.g. the entire line, the carriage motor 34 is commanded by the servo system 56 to accelerate to a carriage printing speed of 100 cps. This is accomplished by the processor 50 addressing the ROM 70 to access the constant COMMAND VELOCITY signal defining the velocity, 100 cps. This 8-bit word is applied to the CPU 76 along the data bus 76 and then from the CPU 76 along the data bus 82 through the controller 80 to the carriage servo system 56. That system compares the 100 cps COMMAND VELOCITY signal with the ACTUAL VELOCITY signal (initially zero). The resultant SERVO ERROR signal is applied to the motor drive circuits 60 to drive the motor 34.

Printing is accomplished by adding to the 8-bit DATA signal (which includes a 7-bit ASCII code as its 7 least significant bits) the value stored in the 4-bit "count-10" counter defined in RAM 62, and then further adding four additional most significant address bits which define the overall region of the ROM 70 to be addressed, as discussed above. The twelve least significant bits define a particular dot column of a particular character, with the thirteenth bit being binary 0 initially to select that portion of the ROM 70 that stores the dot column data for the selected font style of characters printed at 100 cps.

Figure 5:
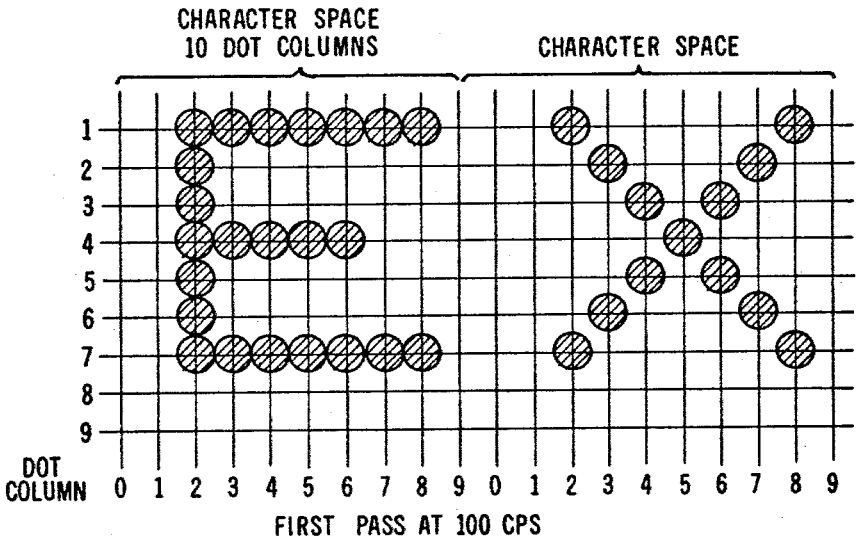
FIG. 5 shows the printed dot matrix patterns for the letters "E" and "X" made after a first pass at 100 cps.

Assume that the first character to be printed is the letter "E" (ASCII 7-bit code is 1000101 -Octal 105). Referring to FIG. 5, the 13 least significant bits of the 16-bit address for the first dot column (dot column 0) of the letter "E" would be "0000001000101." This would address the ROM 70 to access the 8-bit HAMMER DATA word "00000000" stored at the address location. The second dor column (dot column 1) of the letter "E", addressed in ROM by a 16-bit address having its least significant 13 bits equal "0001001000101", would also produce the 8-bit HAMMER DATA word "00000000" stored therein. This same word would also be accessed at the 10th dot column, (dot column 9), as shown in FIG. 5. However, for the third through ninth dot columns (dot columns 2–8), the following 8-bit words would be accessed from the ROM:

TABLE I

LETTER "E" AT 100 CPS

| 16-bit address (13 least significant bits) | dot column | 8-bit HAMMER DATA (bits 8-1) |
|---|---|---|
| 0000001000101 | 0 | 00000000 |
| 0000101000101 | 1 | 00000000 |
| 0001001000101 | 2 | 01111111 |
| 0001101000101 | 3 | 01001001 |
| 0010001000101 | 4 | 01001001 |
| 0010101000101 | 5 | 01001001 |
| 0011001000101 | 6 | 01001001 |
| 0011101000101 | 7 | 01000001 |
| 0100001000101 | 8 | 01000001 |
| 0100101000101 | 9 | 00000000 |

The 10 dot columns for the next letter "X" (7-bit ASCII code is 1011000 -Octal 130) to be printed at 100cps would cause the following 8-bit HAMMER DATA words to be accessed from the ROM 70:

TABLE II

LETTER "X" at 100 CPS

| 16-bit address (13 least significant bits) | dot column | 8-bit HAMMER DATA (bits 8-1) |
|---|---|---|
| 0000001011000 | 0 | 00000000 |
| 0000101011000 | 1 | 00000000 |
| 0001001011000 | 2 | 01000001 |
| 0001101011000 | 3 | 00100010 |
| 0010001011000 | 4 | 00010100 |
| 0010101011000 | 5 | 00001000 |
| 0011001011000 | 6 | 00010100 |
| 0011101011000 | 7 | 00100010 |
| 0100001011000 | 8 | 01000001 |
| 0100101011000 | 9 | 00000000 |

After these two characters are printed, the remaining characters in that print line are printed. If there are no intervening tab stops, a predetermined voltage level comprising the SERVO ERROR signal will be applied to the motor drive circuits 60 to maintain the carriage at 100cps until it is within about 1 character space (about 10 dot columns) of the end of the line. The processor 50 keeps track of the total dot column count for an entire line in a "count-1320" counter defined at two storage locations in RAM 70. When the carriage has moved the print head 38 to witnin 20 dot columns of the end of the line, the velocity table in ROM will be addressed during the time normally allocated for addressing the tenth dot column (dot column 9) of each of these last two character spaces. A count-1320 counter is used inasmuch as there are 132 character spaces per line. Thus, the velocity table in ROM is used for deceleration, as explained previously. At other times, the 8-bit COMMAND VELOCITY signal is generated by addressing one of three storage locations in the ROM velocity table that respectively define carriage COMMAND VELOCITY signals of 100cps (first printing pass), 200cps (second printing pass) and 500cps (horizontal tabbing).

When the first line of characters has been printed at 100cps, the processor 50 controls the paper feed drive circuits 66 to advance the motor 68 such that the paper is advanced upwardly one-half vertical dot space. At the same time, the processor 50 initiates a carriage return. Then, the same characters are printed, but this time in their 200cps dot matrix format.

Figure 6:
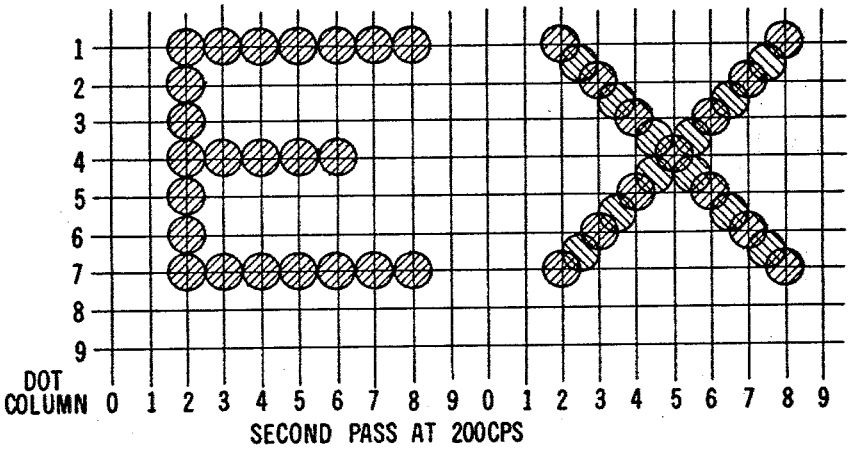
FIG. 6 shows the printed dot matrix patterns for the letters "E" and "X" made after a second pass at 200 cps.

Referring to FIG. 6, it will be noted that the letter "E" was fully formed of desired high resolution during the first pass at 100cps. Accordingly, the 8-bit HAMMER DATA words addressed from ROM 70 for all ten dot columns (i.e. dot columns 9-9) will be "00000000," i.e. no additional dots will be printed during the second printing pass at 200cps. The HAMMER DATA signals for the letters "E" and "X" at 200cps are shown in tables III and IV below.

TABLE III

LETTER "E" AT 200 CPS

| 16-bit address (13 least significant bits) | dot column | 8-bit HAMMER DATA (bits 8-1) |
|---|---|---|
| 1000001000101 | 0 | 00000000 |
| 1000101000101 | 1 | 00000000 |
| 1001001000101 | 2 | 00000000 |
| 1001101000101 | 3 | 00000000 |
| 1010001000101 | 4 | 00000000 |
| 1010101000101 | 5 | 00000000 |
| 1011001000101 | 6 | 00000000 |
| 1011101000101 | 7 | 00000000 |
| 1100001000101 | 8 | 00000000 |
| 1100101000101 | 9 | 00000000 |

TABLE IV

LETTER "X" AT 200 CPS

| 16-bit address (13 least significant bits) | dot column | 8-bit HAMMER DATA (bits 8-1) |
|---|---|---|
| 1000001011000 | 0 | 00000000 |
| 1000101011000 | 1 | 00000000 |
| 1001001011000 | 2 | 00100001 |
| 1001101011000 | 3 | 00010010 |
| 1010001011000 | 4 | 00001100 |
| 1010101011000 | 5 | 00001100 |
| 1011001011000 | 6 | 00010010 |
| 1011101011000 | 7 | 00100001 |
| 1100001011000 | 8 | 00000000 |
| 1100101011000 | 9 | 00000000 |

Figure 7:
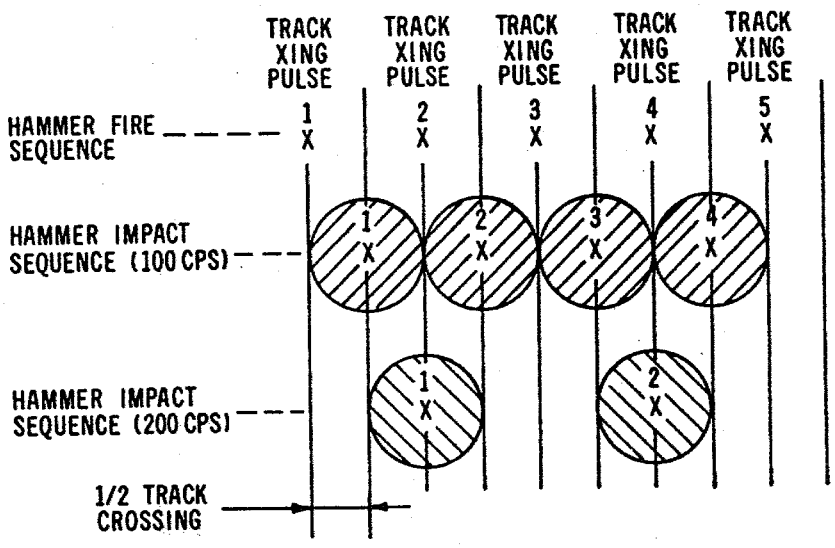
FIG. 7 is a representation of the relationship between the hammer impact sequences at 100 cps and 200 cps and the hammer firing sequence.

An analysis of FIGS. 5 and 6 in conjunction with FIG. 7 reveals that the hammer firing timing sequence corresponds to the frequency of the TRACK CROSSING signal pulses. In this embodiment, and due to the response time of the hammer, the maximum hammer firing sequence would equal one-half the frequency of the TRACK CROSSING signal pulses at 200cps, and would equal such frequency at 100cps. Also, the time it takes a print wire to impact against the platen 16 when fired by the associated hammer is roughly equal to one-half the period between TRACK CROSSING signal pulses when the carriage is traveling at100cps, and roughly equal to such period when the carriage is traveling at 200cps. The result of this, as exemplified by the letter "X" in FIG. 6, is that the dots printed during the second pass at 200cps are offset horizontally one-half dot space from the dots printed during the first pass at 100cps. This is in addition to the dots of the second pass being offset vertically one-half dot space due to the paper advancement. Thus, the dots of the letter "X" printed at 200cps are exactly interspersed with those printed at 100cps, i.e. they lie the 45° diagonal lines of the "X". The result is a very high resolution matrix print with all alphanumeric characters.

It will be readily apparent to those skilled in the programming art that many suitable microcode programs could be written for execution by the processor 50 in order to operate the printer 10 in accordance with the multi-pass matrix printing method of the invention. A presently preferred microcode program, which is merely exemplary, is contained in the file wrapper of the application. As indicated above, the microcode instructions are stored at predetermined address locations of the ROM 70.

Although the invention has been described with respect to a presently preferred embodiment, it will be appreciated by those skilled in the art that various modifications, substitutions, etc. may be made without departing from the spirit and scope of the invention as defined in and by the following claims. For example, the 100cps and 200cps carriage speeds are merely by way of example, as other speeds could be used. Further, the first pass may be at the high speed and the second pass at the low speed. Still further, there may be more than two passes for even higher resolution matrix printing. In the latter event, an equal number of fonts tables for each character font style would have to be defined, with the paper being advanced a corresponding amount of times in the desired and corresponding fractional dot space amount. As another example, the matrix print assembly may be comprised on an ink jet head instead of a wire-matrix head. As yet another example, there may be multiple passes different speeds without interspersed movement of the record material. This would effect greater horizontal dot density. Then, the record material may be advanced followed by one or more additional passes to effect the desired vertical dot density. As still another example, the first pass may be in one direction at a first speed and the second pass in the opposite direction at a second speed.

What is claimed is:

1. In a printer including a record material movable past a printing station, and a print assembly capable of printing a line of characters in dot matrix format upon relative movement of said print assembly and said record material in a first direction, an apparatus for printing said line of characters comprising:

first means for effecting relative movement between said print assembly and said record material in said first direction at a first predetermined speed;

second means responsive to said relative movement in said first direction at said first predetermined speed for activating said print assembly to print during said relative movement a first predetermined number of dots of the dot matrix array defining each character in said line;

third means responsive to the printing of said first predetermined number of dots for effecting relative movement between said print assembly and said record material a predetermined amount in a second direction perpendicular to said first direction, and for effecting relative movement between said print assembly and said record material in a third direction opposite said first direction;

fourth means responsive to said relative movement in said second and third directions for effecting relative movement between said print assembly and said record material in said first direction at a second predetermined speed different than said first predetermined speed; and fifth means responsive to said relative movement in said first direction at said second predetermined speed for activating said print assembly to print during said relative movement a second predetermined number of dots of the dot matrix array defining each character in said line.

2. The printer of claim 1, wherein said printer is a serial printer, said first and third directions are horizontal, and said second direction is vertical.

3. The printer of claim 1, wherein said print assembly includes a wire-matrix print head.

4. The printer of claim 1, wherein said second predetermined speed is twice that of said first predetermined speed.

5. The printer of claim 4, wherein said first predetermined speed is about 100 characters per second and said second predetermined speed is about 200 characters per second.

6. The printer of claim 1, wherein said predetermined amount is equal to one-half the distance between centers of adjacent dot positions in a dot column.

7. The printer of claim 1, wherein said second and fifth means include a read-only-memory having a first group of address locations for storing dot column data for said characters when printed at said first predetermined speed and a second group of address locations for storing dot column data for said characters when printed at said second predetermined speed.

8. The printer of claim 1, wherein each character to be printed in dot matrix format occupies a character space defined by a predetermined number of sequential dot columns, and wherein said second and fifth means includes a random-access-memory having a predesignated address location defining a counter for counting said predetermined number of dot columns.

9. The printer of claim 8, wherein said random-access-memory includes a plurality of predesignated address locations together defining a line buffer for receipt of character code data defining the characters to be printed on a line.

10. In a printer including a record material movable past a printing station and a print assembly capable of printing a line of characters in dot matrix format upon relative movement of said print assembly and said record material in a first direction, a method for printing said line of characters comprising:

effecting relative movement between said print assembly and said record material in said first direction at a first predetermined speed;

activating said print assembly to print during said relative movement a first predetermined number of dots of the dot matrix pattern defining each character in said line;

effecting relative movement between said print assembly and said record material a predetermined amount in a second direction perpendicular to said first direction, and in a third direction opposite said first direction;

effecting relative movement between said print assembly and said record material in said first direction at a second predetermined speed different than said first predetermined speed; and activating said print head to print during said relative movement a second predetermined number of dots of the dot matrix pattern defining each character in said line.

11. The method of claim 10, wherein said first and third directions are horizontal and said second direction is vertical.

12. The method of claim 10, wherein said second predetermined speed is twice that of said first predetermined speed.

13. The method of claim 12, wherein said first predetermined speed is about 100 characters per second and said second predetermined speed is about 200 characters per second.

14. The method of claim 10, wherein said predetermined amount is equal to one-half the distance between centers of adjacent dot positions in a dot column.

15. In a printer including a record material movable past a printing station, and a print assembly capable of printing a line of characters in dot matrix format upon relative movement of said print assembly and said record material in a first direction, an apparatus for printing said line of characters comprising:

said means for effecting relative movement between said print assembly and said record material in said first direction at a first predetermined speed;

second means responsive to said relative movement in said first direction at said first predetermined speed for activating said print assembly during said relative movement to print a first predetermined number of dots of the dot matrix array defining each character in said line;

third means for effecting relative movement between said print assembly and said record material in said first direction at a second predetermined speed different than said first predetermined speed; and fourth means responsive to said relative movement in said first direction at said second predetermined speed for activating said print assembly during said relative movement to print a second predetermined number of dots of the dot matrix array defining each character in said line.

16. In a printer including a record material movable past a printing station, and a print assembly capable of printing a line of characters in dot matrix format upon relative movement of said print assembly and said record material in first and second directions, an apparatus for printing said line of characters comprising;

first means for effecting relative movement between said print assembly and said record material in said a first direction at a first predetermined speed;

second means responsive to said relative movement in said first direction at said first predetermined speed for activating said print assembly during said relative movement to print a first predetermined number of dots of the dot matrix array defining each character in said line;

third means for effecting relative movement between said print assembly and said record material in a second direction opposite said first direction at a second predetermined speed different than said first predetermined speed; and fourth means responsive to said relative movement in said second direction at said second predetermined speed for activating said print assembly during said relative movement to print a second predetermined number of dots of the dot matrix array defining each character in said line.

17. The printer of claim 15 or claim 16, wherein said second means comprises a read-only-memory including a first font table having addressable storage locations for storing dot column data for said characters when printed at said first predetermined speed, and a corresponding first velocity table having addressable storage locations for storing deceleration velocity levels for stopping said print assembly at a predetermined location along the print line.

18. The printer of claim 17, wherein said fourth means comprises a read-only-memory including a second font table having addressable storage locations for storing dot column data for said characters when printed at said second predetermined speed, and a corresponding second velocity table having addressable locations for storing deceleration velocity levels for stopping said print assembly at a predetermined location along the print line.

* * * * *